US008869316B2

(12) United States Patent
Lewis

(10) Patent No.: US 8,869,316 B2
(45) Date of Patent: Oct. 28, 2014

(54) ARTICULATED BODY ARMOUR

(76) Inventor: Christopher Mark Lewis, Rhondda Cynon Taff (GB)

( * ) Notice: Subject to any disclaimer, the term of this patent is extended or adjusted under 35 U.S.C. 154(b) by 559 days.

(21) Appl. No.: 12/999,718

(22) PCT Filed: Jun. 18, 2009

(86) PCT No.: PCT/GB2009/001551
§ 371 (c)(1),
(2), (4) Date: Apr. 26, 2011

(87) PCT Pub. No.: WO2010/007343
PCT Pub. Date: Jan. 21, 2010

(65) Prior Publication Data

US 2011/0185483 A1 Aug. 4, 2011

(30) Foreign Application Priority Data

Jun. 23, 2008 (GB) ..... 0811480.3
Nov. 17, 2008 (GB) ..... 0820973.6

(51) Int. Cl.
*A41D 13/00* (2006.01)
*F41H 1/02* (2006.01)

(52) U.S. Cl.
CPC ..... *F41H 1/02* (2013.01)
USPC ..... 2/463

(58) Field of Classification Search
USPC ..... 2/268, 461–463
See application file for complete search history.

(56) References Cited

U.S. PATENT DOCUMENTS

| | | | |
|---|---|---|---|
| 1,633,610 | A | 6/1927 | Schneider |
| 1,657,094 | A | 1/1928 | Rutledge |
| 1,720,439 | A | 7/1929 | Richardson |
| 1,863,482 | A | 6/1932 | Isaacs |

(Continued)

FOREIGN PATENT DOCUMENTS

| | | |
|---|---|---|
| WO | WO 03/027600 | 4/2003 |
| WO | WO2009/055850 | 5/2009 |
| WO | WO2009/114147 | 9/2009 |

OTHER PUBLICATIONS

International Search Report from PCT/GB2009/001551 dated Jan. 15, 2010.

(Continued)

*Primary Examiner* — Katherine Moran
(74) *Attorney, Agent, or Firm* — Workman Nydegger

(57) ABSTRACT

A modular body armor system (100) includes an upper shoulder harness (102) in which shoulder straps (106, 108) are pivotally rotatable relative to each other and also to front and back connecting bridges (112, 114) that define a closed loop for the harness (102). Armor plates (124, 126) are attachable to the bridges (112, 114) and extend generally downwardly to protect the front and back torso regions of a wearer of the body armor (100). Pivotal articulation of the body armor (100) permits the armor to roll advantageously with the movement of its wearer such that movement, such as crouching or the adoption of a firing position, is not generally restricted. A lower girdle (104) incorporates additional plates and panels (140, 142, 105, 152) to provide enhanced protection to the wearer, which lower girdle (104) may be entirely independent of the upper shoulder harness (102). By providing for chest expansion through an elasticated connection within both the shoulder harness (102) and the lower girdle (104), a wearer is placed under less physiological stress during times of exertion and mental stress, thereby improving the overall performance of the wearer.

12 Claims, 8 Drawing Sheets

(56) References Cited

U.S. PATENT DOCUMENTS

| | | | | |
|---|---|---|---|---|
| 1,887,473 | A | 11/1932 | Warner | |
| 2,116,822 | A | 5/1938 | Berger | |
| RE21,269 | E | 11/1939 | Copeman | |
| 2,204,380 | A | 6/1940 | Pray | |
| 2,216,897 | A | 10/1940 | Zoob | |
| 2,562,951 | A | 8/1951 | Rose | |
| 2,748,391 | A | 6/1956 | Frederick | |
| 2,755,475 | A | 7/1956 | Lipshitz | |
| 2,790,973 | A | 5/1957 | Lewis | |
| 2,879,654 | A | 3/1959 | Evans | |
| 3,083,710 | A | 4/1963 | Rauser | |
| 3,127,614 | A | 4/1964 | Bennett | |
| 3,331,083 | A | 7/1967 | Holly | |
| 3,418,660 | A | 12/1968 | Shumate | |
| 3,431,560 | A * | 3/1969 | Austin | 2/462 |
| RE26,682 | E | 10/1969 | Terry | |
| 3,509,579 | A * | 5/1970 | Morgan | 2/462 |
| 3,740,763 | A | 6/1973 | Mitchell | |
| 3,743,263 | A | 7/1973 | Szekely | |
| 3,771,171 | A | 11/1973 | Mitchell | |
| 3,829,899 | A | 8/1974 | Davis | |
| 3,981,027 | A * | 9/1976 | Anderson | 2/462 |
| 4,183,097 | A | 1/1980 | Mellian | |
| 4,316,286 | A | 2/1982 | Klein | |
| 4,371,989 | A | 2/1983 | Polsky | |
| 4,460,393 | A | 7/1984 | Saget | |
| 4,475,247 | A | 10/1984 | Lee | |
| 4,488,317 | A | 12/1984 | Polsky | |
| 4,507,802 | A | 4/1985 | Small | |
| 4,516,273 | A | 5/1985 | Gregory et al. | |
| 4,578,821 | A | 4/1986 | Zufle | |
| 4,670,913 | A | 6/1987 | Morell | |
| 4,722,099 | A | 2/1988 | Kratz | |
| 4,785,480 | A | 11/1988 | Polsky | |
| 4,843,654 | A | 7/1989 | March | |
| 5,008,959 | A | 4/1991 | Coppage | |
| 5,044,011 | A | 9/1991 | Henderson | |
| 5,136,724 | A | 8/1992 | Grilliot | |
| 5,160,693 | A | 11/1992 | Eckert | |
| 5,161,257 | A | 11/1992 | Arensdorf | |
| 5,172,426 | A | 12/1992 | Capello | |
| 5,210,877 | A | 5/1993 | Newman | |
| 5,299,602 | A | 4/1994 | Barbeau | |
| 5,327,811 | A | 7/1994 | Price | |
| 5,362,527 | A | 11/1994 | Harpell | |
| 5,373,582 | A | 12/1994 | Dragone | |
| 5,398,339 | A | 3/1995 | Wagner | |
| 5,398,340 | A | 3/1995 | Kibbee | |
| 5,443,882 | A | 8/1995 | Park | |
| 5,443,883 | A | 8/1995 | Park | |
| 5,471,906 | A | 12/1995 | Bachner | |
| 5,495,620 | A | 3/1996 | Schoenweiss | |
| 5,495,621 | A | 3/1996 | Kibbee | |
| 5,542,124 | A | 8/1996 | Grilliot | |
| 5,572,737 | A | 11/1996 | Valice | |
| 5,632,137 | A | 5/1997 | Kolmes | |
| 5,689,836 | A | 11/1997 | Fee | |
| 5,694,981 | A | 12/1997 | Stanhope | |
| 5,754,982 | A | 5/1998 | Gainer | |
| 5,773,370 | A | 6/1998 | Dunbar | |
| 5,794,262 | A | 8/1998 | Capello | |
| 5,829,653 | A | 11/1998 | Kaiser | |
| 5,860,163 | A | 1/1999 | Aldridge | |
| 5,918,319 | A | 7/1999 | Baxter | |
| 5,926,856 | A | 7/1999 | Duval | |
| 5,958,804 | A | 9/1999 | Brown | |
| 5,970,513 | A | 10/1999 | Kocher | |
| 5,974,585 | A | 11/1999 | Bachner | |
| 5,996,115 | A | 12/1999 | Mazelsky | |
| 6,026,510 | A | 2/2000 | Kocher | |
| 6,041,437 | A | 3/2000 | Barker | |
| 6,041,441 | A | 3/2000 | Counts | |
| 6,041,442 | A | 3/2000 | Owen | |
| 6,103,641 | A | 8/2000 | Gehring | |
| 6,145,132 | A | 11/2000 | Towner | |
| 6,260,196 | B1 | 7/2001 | van der Sleesen | |
| 6,453,791 | B1 | 9/2002 | Seitzinger | |
| 6,490,733 | B1 | 12/2002 | Casaubon | |
| 6,519,781 | B1 | 2/2003 | Berns | |
| 6,627,562 | B1 | 9/2003 | Gehring | |
| 6,651,543 | B2 | 11/2003 | Park | |
| 6,667,255 | B2 | 12/2003 | Hexels | |
| 6,698,024 | B2 | 3/2004 | Graves | |
| 6,738,984 | B2 | 5/2004 | Gillen | |
| 6,745,394 | B1 | 6/2004 | Rutherford | |
| 6,779,330 | B1 | 8/2004 | Andrews | |
| 6,841,492 | B2 | 1/2005 | Bhatnagar | |
| 6,846,545 | B2 | 1/2005 | Thomas | |
| 6,861,378 | B2 | 3/2005 | Cunningham | |
| 6,961,958 | B1 | 11/2005 | Seitzinger | |
| 7,010,811 | B1 | 3/2006 | Park | |
| 7,017,193 | B2 | 3/2006 | Auger | |
| 7,043,766 | B1 | 5/2006 | Foreman | |
| 7,062,789 | B1 | 6/2006 | Blackwell | |
| 7,073,538 | B2 | 7/2006 | Bhatnagar | |
| 7,150,217 | B2 | 12/2006 | Kershaw | |
| 7,181,774 | B2 | 2/2007 | Silver | |
| 7,386,894 | B2 | 6/2008 | Straiton | |
| 7,500,274 | B1 | 3/2009 | Kallen | |
| 7,512,995 | B2 | 4/2009 | Deffner | |
| 7,578,005 | B2 | 8/2009 | Vereen | |
| 7,589,036 | B2 | 9/2009 | Corner | |
| 7,712,148 | B2 | 5/2010 | Carlson | |
| 7,765,624 | B1 * | 8/2010 | Larson et al. | 2/459 |
| 7,774,865 | B2 | 8/2010 | Miller | |
| 7,784,116 | B2 | 8/2010 | Gallo | |
| 7,810,167 | B2 | 10/2010 | Seitzinger | |
| 7,849,522 | B2 | 12/2010 | Roux | |
| 7,900,271 | B2 | 3/2011 | Sonner | |
| 7,937,771 | B2 | 5/2011 | Mazzarolo | |
| 7,937,780 | B2 | 5/2011 | Matic | |
| 7,987,521 | B2 | 8/2011 | Vereen | |
| 8,095,996 | B2 | 1/2012 | Turner | |
| 8,108,947 | B2 | 2/2012 | Beauvais | |
| 8,146,176 | B2 | 4/2012 | Rudolph | |
| D663,923 | S | 7/2012 | Karik | |
| 8,347,422 | B2 | 1/2013 | Kalaam | |
| 2002/0155773 | A1 | 10/2002 | Maini | |
| 2003/0109188 | A1 | 6/2003 | Hartert | |
| 2003/0167557 | A1 | 9/2003 | LaShoto | |
| 2003/0226197 | A1 | 12/2003 | Cramer | |
| 2004/0019950 | A1 | 2/2004 | Rast | |
| 2004/0023580 | A1 | 2/2004 | Hand | |
| 2004/0064865 | A1 | 4/2004 | Hummel | |
| 2004/0065072 | A1 | 4/2004 | Zhu | |
| 2004/0235383 | A1 | 11/2004 | Perry | |
| 2005/0034219 | A1 | 2/2005 | Lowry | |
| 2005/0066408 | A1 | 3/2005 | Varela | |
| 2005/0081571 | A1 | 4/2005 | Bhatnagar | |
| 2005/0108800 | A1 | 5/2005 | White | |
| 2005/0229293 | A1 | 10/2005 | Miller | |
| 2006/0062944 | A1 | 3/2006 | Gardner | |
| 2006/0206986 | A1 | 9/2006 | Straiton | |
| 2006/0230484 | A1 | 10/2006 | Schultz | |
| 2006/0242750 | A1 | 11/2006 | Vereen | |
| 2006/0260026 | A1 | 11/2006 | Doria | |
| 2007/0016996 | A1 | 1/2007 | Seitzinger | |
| 2007/0094763 | A1 | 5/2007 | Silver | |
| 2007/0271965 | A1 | 11/2007 | Kolmes | |
| 2008/0010730 | A1 | 1/2008 | Twito | |
| 2008/0104743 | A1 | 5/2008 | Ng | |
| 2008/0155737 | A1 | 7/2008 | Marchesi | |
| 2008/0178358 | A1 | 7/2008 | Learmont | |
| 2008/0184467 | A1 | 8/2008 | Brassill | |
| 2008/0295210 | A1 | 12/2008 | Matic | |
| 2008/0295231 | A1 | 12/2008 | Wright | |
| 2009/0013451 | A1 | 1/2009 | Baxter | |
| 2009/0019612 | A1 | 1/2009 | Schulein | |
| 2009/0025126 | A1 | 1/2009 | Crossman | |
| 2009/0075019 | A1 | 3/2009 | Loos | |
| 2010/0043116 | A1 | 2/2010 | Vereen | |
| 2010/0050699 | A1 | 3/2010 | Kolmes | |
| 2010/0175430 | A1 | 7/2010 | Garcia | |
| 2010/0186134 | A1 | 7/2010 | Hunter | |

| | | | |
|---|---|---|---|
| 2010/0206472 | A1 | 8/2010 | Kim |
| 2010/0212056 | A1 | 8/2010 | Sullivan |
| 2010/0229273 | A1 | 9/2010 | Crye |
| 2010/0325766 | A1 | 12/2010 | Mackintosh |
| 2011/0072545 | A1 | 3/2011 | Bennett |
| 2011/0131694 | A1 | 6/2011 | Fearon |
| 2011/0167545 | A1 | 7/2011 | Garcia |
| 2011/0277202 | A1 | 11/2011 | McQueer |
| 2012/0117700 | A1 | 5/2012 | Howell |
| 2012/0260400 | A1 | 10/2012 | Franz |
| 2013/0019365 | A1 | 1/2013 | Howell |
| 2013/0074251 | A1 | 3/2013 | Crye |
| 2013/0212791 | A1 | 8/2013 | Hocking |

OTHER PUBLICATIONS

Written Opinion from PCT/GB2009/001551 dated Jan. 15, 2010.
U.S. Appl. No. 13/624,363, Sep. 6, 2013, Final Office Action.
U.S. Appl. No. 12/948,183, Jul. 1, 2013, Notice of Allowance.
Imperial Armour "Technical Specifications Imperial Armour Designer Ballistic Briefs" 1 page (Circa 2010).
Illusion Militaria "Buaer Flak Short" website available: http://www.illusion.org.cn/cp_detail.php?id=18654&nowmenuid=49087&catid=0 (Buaer Short, Circa 1957).
U.S. Appl. No. 12/948,183, Nov. 19, 2012, Office Action.
U.S. Appl. No. 13/624,363, Feb. 20, 2013, Office Action.
U.S. Appl. No. 12/948,183, Mar. 6, 2013, Final Office Action.
Photograph of Henry VIII's Armor circa 1540; Greenwich; Henryviii[1].jpeg.
Photograph of Henry VIII's Armor circa 1540; Greenwich; HRVIIIArmour[1].jpeg.
Photograph of Henry VIII's Armor circa 1540; Greenwich; IMG_3326[1].jpeg.
U.S. Appl. No. 13/934,066, Oct. 31, 2013, Notice of Allowance.
U.S. Appl. No. 13/934,066, Feb. 19, 2014, Notice of Allowance.

* cited by examiner

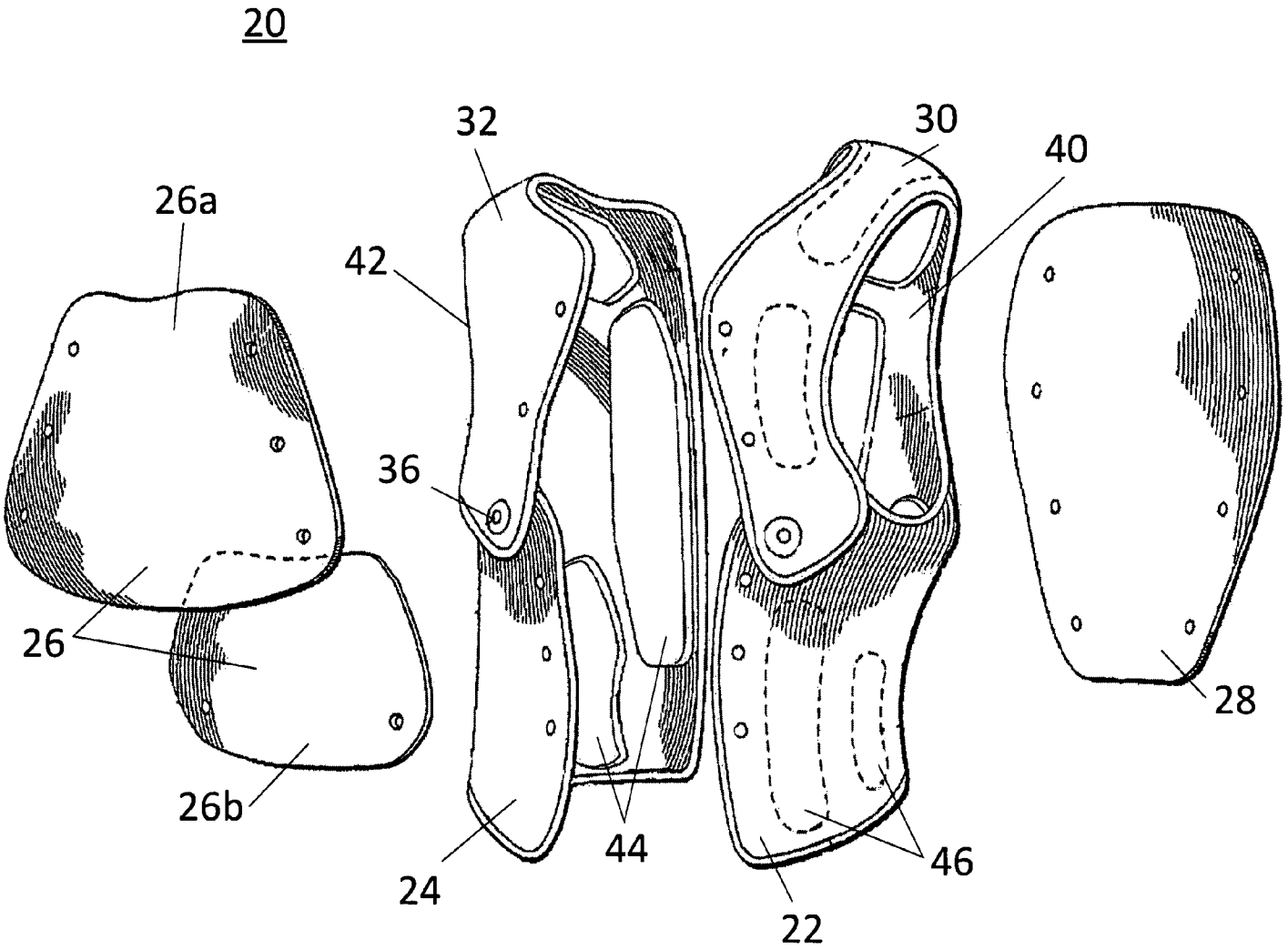
Fig.1: Prior Art

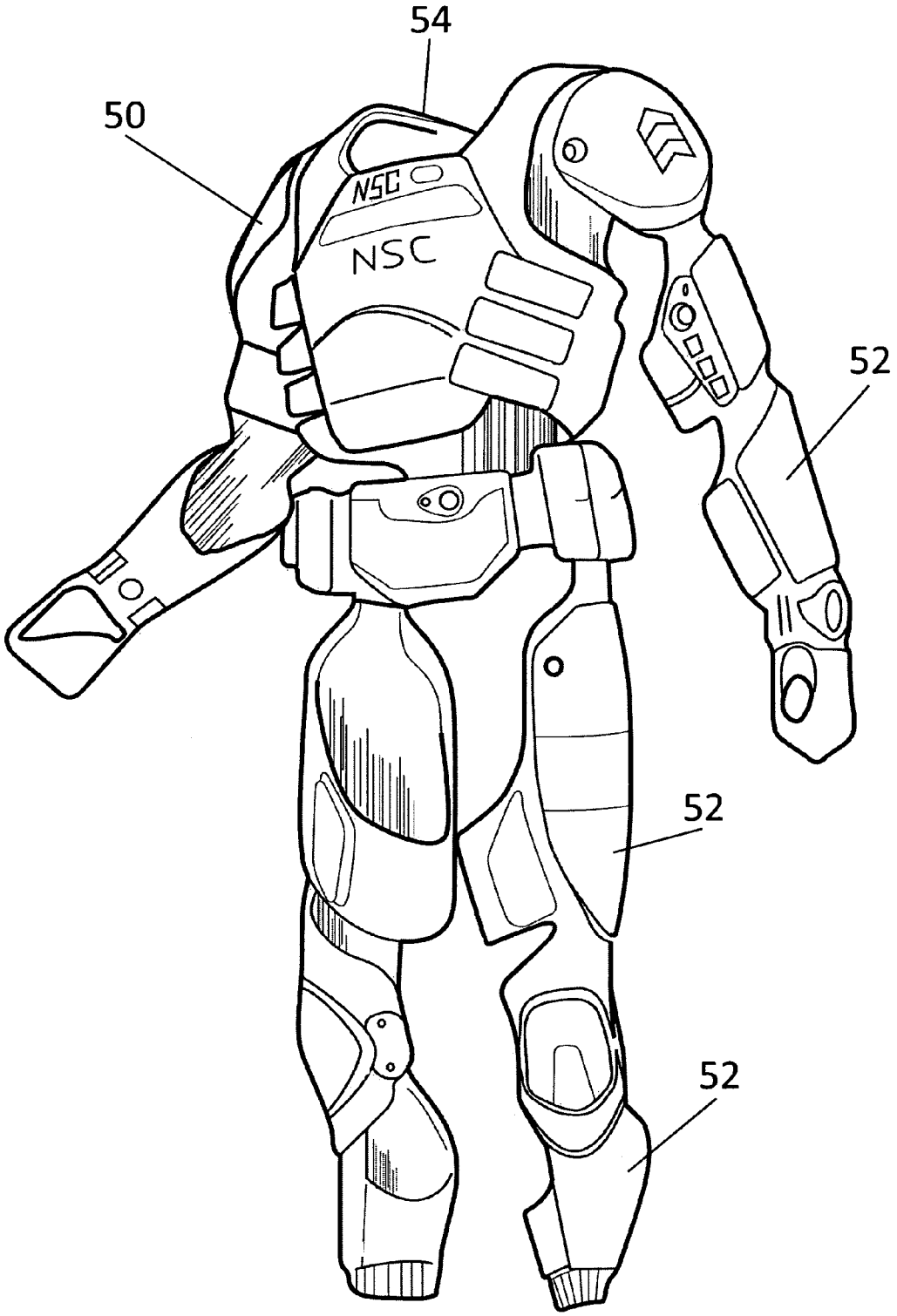
Fig.2: Prior Art

ARTICULATED BODY ARMOUR

FIELD OF THE INVENTION

This invention relates, in general, to body armour that provides a protective shield against general bodily injury or acute trauma. More particularly, but not exclusively, the present invention relates to personal body armour that can provide ballistic protection against projectile threats, such as high velocity rifle rounds.

SUMMARY OF THE PRIOR ART

Security personnel, including policemen, infantry soldiers and special operations forces, are often now equipped with tactical protection in the form of body armour or protective vests to mitigate injury from attack. Such body armour is available in a variety of forms to address varying levels of potential threat, e.g. from bullets and knives.

So-called "soft armour" is worn in the form of jackets and vests and is composed of assemblies of ballistic fibres, such as those formed from Kevlar® from the DuPont company. Typically, soft armour will employ fifteen to thirty layers of thin, flexible and tightly-woven ballistic fabrics that is generally lightweight and effective and stopping handgun rounds. In building up the layers, the resultant garment tends to be very stiff and restrictive of free movement. In normal use, soft armour generally protects against blunt trauma.

To provide adequate protection against more serious threats, such as high velocity rifle rounds, soft-armour is augmented or otherwise substituted by the use of "hard armour". Hard armour can be considered to be equivalent to an exoskeleton in that it is fabricated from rigid plates made from ceramic, polymers or metal sheets. These plates are usually molded or generally formed to conform to the physique of a standard wearer. Clearly, greater protection is achieved through the use of large plates of hard armour, although this has a drawback in that the plates are both relatively heavy and cumbersome and thus increase fatigue and interfere with a wearer's mobility (even more so than that of soft armour).

A common approach to mounting plates of hard armour to a wearer is to secure them within exterior pockets fabricated on a soft armour jacket or vest. Such a modular approach allows the wearer to assess the level of risk and to add or subtract hard armour if and when the situation allows.

U.S. Pat. No. 6,892,392 shows a body armour system with overlapping front or rear plates allowing some increased movement when bending forwards, however this system does not allow for the free independent movement of the shoulders, hips and torso when in the standing or kneeling positions.

WO 03/027600 (Crye Associates) discloses personal body armour in which a soft armour vest in comprised from single-piece, left hand and right hand side panels that are coupled together with front and rear hard armour plates that provide a protective shield for major organs in the chest and torso. The side panels include integrally formed shoulder straps that loop over from the rear to permit attachment to a front-side flank to form holes through which a wearer may extend their arms. Foam pads are positioned against an inner surface of the soft armour to effect spacing of the soft armour from the body of a wearer. The overall length of the body armour may be increased through the use of soft armour belt that can itself attach to the side panels and which uses a buckle for fastening around the waist of the user. WO 03/027600 forms the basis of commercially available Scorpion body armour from Crye.

However, like other prior art systems, the combination of bulk in the soft armour and heavy plating restricts overall movement for the wearer.

Specific body areas, such as the thighs, can be protected using soft armour pads that are affixed to the wearer using buckles and webbing, such as seen in the Crye Associates' "Extremity Armour System". Other conceptual designs from Crye Associates (see http://www.cryeassociates.com/11.htm#) extend the idea of a large-scale, rigid exoskeleton into a full suit in which surrounds major muscle groups, joints and major organs are covered with inflexible panels of soft and/or hard armour, with joint movement permitted only apparently by virtue of either a connecting flap of webbing or lack of protective armour.

Unfortunately, the selective ability to remove hard armour to benefit from increased mobility compromises the wearer's overall degree of protection. Conversely, any restriction of a wearer's ability to move into an effective offensive position or take up a protective position (e.g. behind a wall) compromises the wearer's ability to function or otherwise exposes the wearer as a larger target from either delaying or inhibiting the taking up of a defensive posture. Likewise, the current construction of multi-layered soft armour and its resulting bulk is also not ideal.

SUMMARY OF THE INVENTION

According to a first aspect of the present invention there is provided body armour comprising a left shoulder strap and a right shoulder strap connected together by at least one rotatable joint that allows each of the left shoulder strap and the right shoulder strap independently to rotate about the at least one rotatable joint.

In a preferred embodiment, the Articulated body armour further comprises: an upper harness including the left shoulder strap and the right shoulder strap and a chassis realised by at least a front bridge and a back bridge, at least one of the front bridge and the back bridge formed as a separate component from the shoulder straps, the upper harness assembled through intercoupling of the left and right shoulder straps via the front bridge and back bridge, the intercoupling achieved through at least two pivoting joints that allow each shoulder strap to rotate relative to at least one of the front bridge and the back bridge. Alternatively, the left shoulder strap and the right shoulder strap include bridging material extending substantially inwardly and tangentially from lower regions of the shoulder straps, the left shoulder strap rotatably coupled to the right shoulder strap through a central joint positioned in overlapping bridging material (37) from both shoulder straps.

In one particular embodiment, the front and back bridges are formed as separate components from the left and right shoulder straps; and at least four pivoting joints, at least four pivoting joints, one pivoting joint located at each end of each shoulder strap and each pivoting joint coupling the end of its respective shoulder strap to one of the front bridge and the back bridge.

In another independent aspect there is provided articulated body armour comprising an upper harness arranged, in use, to encircle the shoulder's of wearer, the body armour further including at least one of a front plate and a back plate that extends downwardly from the harness to cover, in use, a wearer's torso, wherein at least the front plate is attached to the upper harness through a coupling that allows the front plate to swivel about the coupling.

In both alternative aspects, a preferred embodiment includes a chest strap incorporated into the upper harness, the chest strap coupling a left shoulder strap to a right shoulder strap to allow size adjustment of the upper harness, the chest strap including an elasticated region that pre-tensions the upper harness and permits the upper harness to undergo expansion and contraction when fitted, in use, around a wearer's shoulders and chest.

In overview, the present invention provides an articulated and modular system of body armour in which components are able to rotate about fixings that hold the components together. Some joints allow pivotal and/or linear movements of one component relative to another, e.g. a spherical ball and socket joint or a peg and running slot. By having modular sections of soft armour (or its functional equivalent) in the upper harness 102 and lower girdle 104, the present invention makes use these modular panels to effect a spacing away of the body armour from the wearer's body; this aids in air circulation and heat control. The use of webbing and adjustable straps permits the lengths and/or angles of the various modular components to be altered in relation to each other. The elastic elements connecting the modular panels and plates also allow the body armour to flex so that the wearer is free to twist their torso at times when the wearer is looking backwards or when kneeling down in the firing position.

The present invention advantageously provides a modular body armour system that is articulated in a way that permits the armour to roll with the movement of its wearer. In this way, the body armour is less restrictive of movement. By providing for chest expansion through an elasticated connection within the shoulder harness and lower girdle of the body armour, a wearer is placed under less physiological stress during times of exertion and mental stress, thereby improving the overall performance of the wearer.

BRIEF DESCRIPTION OF THE DRAWINGS

Exemplary embodiments of the present invention will now be described with reference to the accompanying drawings, in which:

FIG. 1 is an exploded view of prior art body armour comprised from unitary, soft armour side panels and hard armour plates that attach to and couple together the side panels;

FIG. 2 is a conceptual view of prior art body armour encompassing a rigid exoskeleton;

DETAILED DESCRIPTION OF A PREFERRED EMBODIMENT

Figure 4:
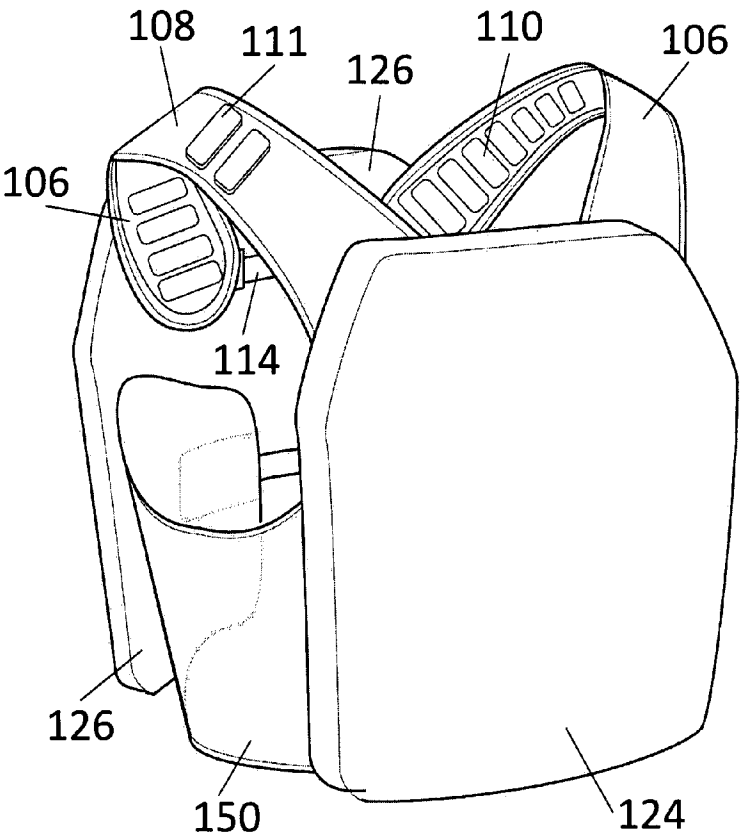
FIG. 4 is a perspective side view of the body armour of FIG. 3 including hard armour plates.

Referring to FIG. 1 there is shown an exploded view of prior art body armour system 20 in accordance with WO 03/027600. Essentially, left hand and right hand side panels 22, 24 (made from soft armour) are coupled together using front 26 and rear 28 hard armour plates that align and marginally overlap with edges of (and affix to) the side panels 22, 24. The front plate 26 may include overlapping plates 26*a*, 26*b*, if desired, to extend the overall amount of torso protection. The side panels 22, 24 include integrally formed shoulder straps 30, 32 that loop over from the rear to permit attachment 36 to a front-side flank to form holes 40, 42 through which a wearer may extend their arms. Foam pads 44, 46 are positioned against an inner surface of the soft armour to effect spacing of the soft armour from the body of a wearer.

In FIG. 2 an all-over body armour system 50 is shown. In what can best be described as a Star Wars "Stormtrooper" approach, a rigid exoskeleton made up of scalloped and sculptured soft armour panels 52 and hard armour plates 54 is positioned and wrapped over major sections of the wearer's body, including the torso, arms, elbows, knees and legs.

Figure 3:
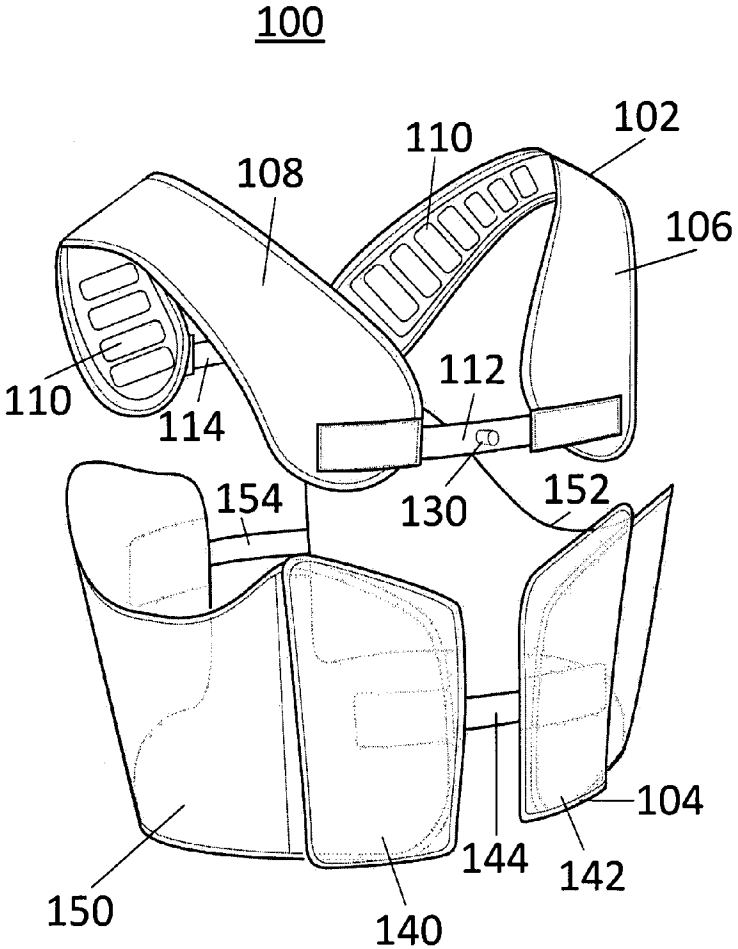
FIG. 3 is a perspective view of partially assembled body armour according to an embodiment of the present invention.
Figure 5:
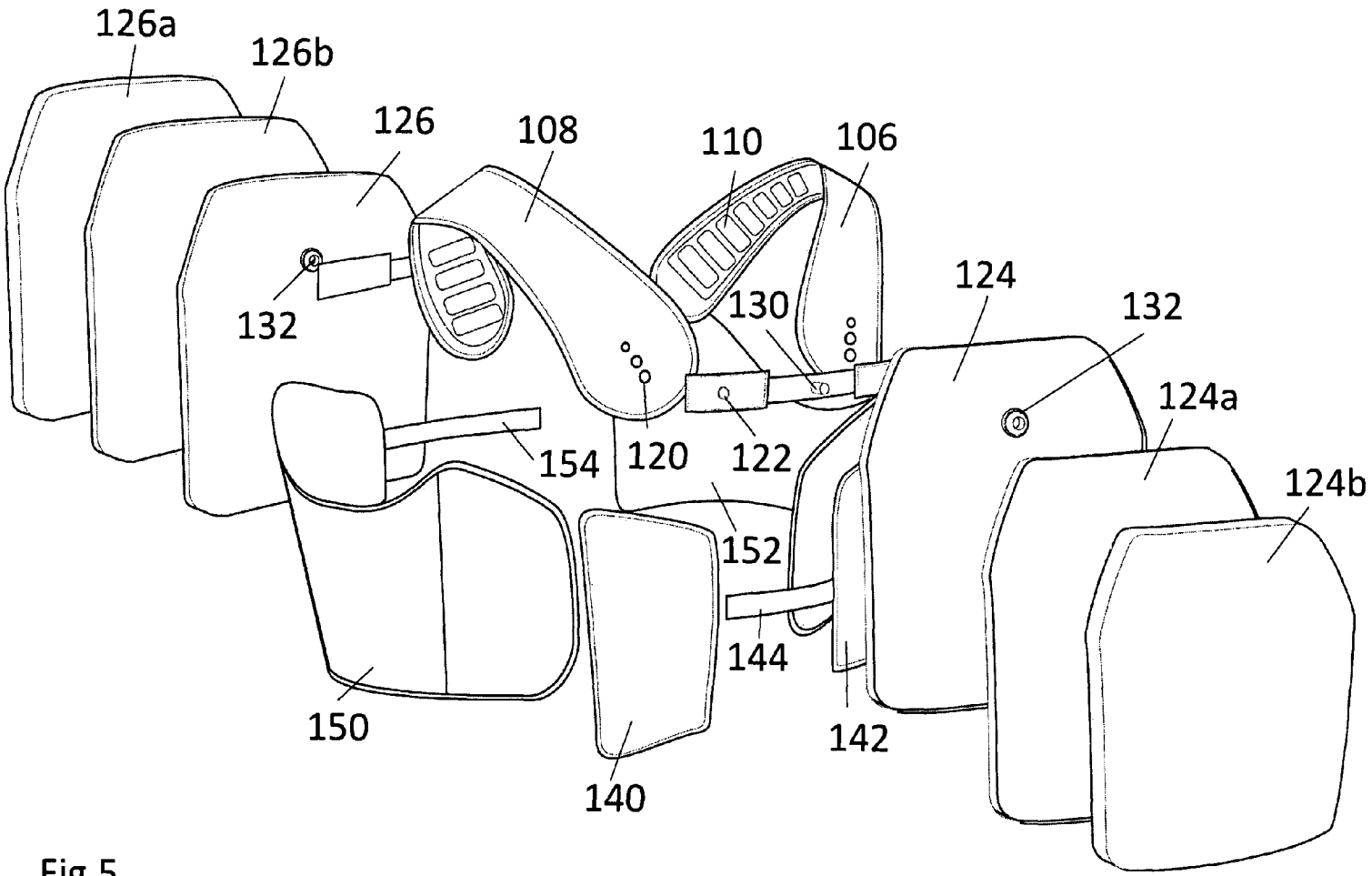
FIG. 5 is an exploded view of the body armour of FIG. 4.

With reference to FIGS. 3 to 5 in combination, there is shown a perspective view of body armour 100 according to a preferred embodiment of the present invention. Essentially, the body armour contains an upper shoulder harness 102 and a lower girdle 104 that primarily protects the main organs and flanks on the torso of a wearer.

The upper shoulder harness 102 includes a pair of shoulder straps 106, 108 that are constructed in soft armour and preferably includes areas of (at least) internal padding 110 that provides comfort to a wearer and force dissipation following projectile impact with the body armour 100. External padding 111 on the shoulder straps is shown in a limited and purely illustrative fashion only on a portion of the right shoulder strap 108 of FIG. 4. Padding may include a phase change material that becomes rigid when put under pressure, as would happen when the armour system was impacted by a projectile.

The broad tailoring of each shoulder strap 106, 108 provides load dissipation of the mass of the body armour, while the sculpting of the shape of the shoulder straps preferably maximises the amount of coverage over the pectoralis and trapezius muscle groups in the upper torso. A left shoulder strap 106 is connected to the right shoulder strap 108 at both the front and back of each strap by suitable linking element such as a front bridge/connector 112 and a back bridge/connector 114, thereby producing a, closed circuit within the upper harness of the body armour. The bridges 112, 114 are typically rigid and may be made from a material coated plastic or lightweight metal strut, such as a flat aluminium bar. The bridges may be realised by sub-assemblies that permit overall adjustable in their separation.

The connection of each bridge to an end of each strap is by way of at least one pivoting or swivel joint (see reference numerals 120, 122 in FIG. 5) and preferably front and back pivoting joints that permit(s) arcuate, rotational and independent movement of each shoulder strap 106, 108 relative to each bridge 112, 114. Shoulder straps are therefore generally free to move in relation to each other (as indicated by arrows) allowing users of different shapes to wear the system comfortably at times when the wearer's posture or movement is changing. The pivotal movement of the bridge 112, 114 therefore allows for the independent movement of each shoulder; this contrasts with the restricted movement that arises when the shoulder straps are directly attached to the front or back of the jacket or where the direct attachment of a frontal plate does not allow such independent movement of each shoulder.

The pivoting joint 120, 122 can be realised as a ball and socket, for example, where a ball-shaped pin extends outwardly from the shoulder strap and a socket in the bridge receives the head of the ball. Alternatively, a simple hole and toggle could be employed. As shown in FIG. 5, multiple ball-shaped pins can be provided in a line along the shoulder strap to allow for size adjustment. The exact nature of the pivoting joint can take on a number of alternative forms, as will readily be appreciated, since the necessity for rotation defines the design implementation. A preferred way of providing a swivelling joint will be described later in relation to FIGS. 12 to 14.

To prevent the shoulder straps from continuously rotating to an open position below the horizontal, the bridge may inherently be arranged (or otherwise be supplemented by a secondary elastic cord) to limit the arcuate rotational movement of each shoulder straps to less than ninety degree and preferably less than about sixty degrees (relative to the vertical). In use, movement of the shoulders of the wearer is thus compensated for by rotational movement of the shoulder straps; this keeps the body armour generally in place over the torso of the wearer and ensures freedom of movement of the shoulders independent of the rest of the wearer's body.

The front bridge 112 and back bridge 114 also act to provide a support for direct or indirect mounting a front plate or chassis 124 and rear plate or chassis 126, i.e. the bridges act as a plate carrier. The front chassis 124 and the rear chassis 126 may be realised by soft armour and therefore these chassis' can therefore provide a first line of torso protection. A more detailed understanding of the nature and function of body chassis will be described subsequently in relation to FIGS. 11, 12 and 14.

The front chassis 124 may be realised by multiple layers, including any appropriate combination of soft armour and/or heavy armour layers or plates, including those having a ceramic, polymer, metal or composite and laminate structures. The rear chassis 126 may likewise have a multi-layer construction. Connection of the front chassis 124 and rear chassis 126 to the respective front bridge 112 and back bridge 114 may be permanent or temporary and can make use of webbing loops, ties, poppers, Velcro® and the like 115. Mounting of the respective bridge to its respective chassis may be through a single, central point or at multiple points; this is merely design option. A preferred mounting arrangement will be discussed subsequently with reference to FIG. 11.

The front bridge 112 and the back bridge are preferably realised by a structural plastic element (rather than an alternative flat metal strip) that exhibits no or minimal ballistic properties. By using a plastic bridge, blunt trauma arising upon impact of a projectile with the plastic bridge may be reduced. Additionally, by making the bridge in a flexible material, the bridge 112, 114 can be flexed in both a forward or backward direction. Flexing in this plane therefore complements the pivoting action of the bridge 112, 114 relative to the shoulder straps 106, 108, thereby accentuating the overall movement within the upper harness 102.

Ends of bridges 112, 114 are preferably located within elasticated pockets formed in a rear surface of the shoulder straps 106, 108. While the bridge is held in place in the pocket during rest, chest expansion under heavy breathing permits the pocket to stretch to provide lateral movement or flexing of the modular components across the body armour 100.

In one particular embodiment that may be implemented independently of the preferred rotational or swivelling nature of the shoulder straps 106, 108, the front and back bridges optionally (and independently) each include a spherical connector 130 that engages into a corresponding receptor 132, whereby the connection permits limited pivoting movement of at least one of the front chassis 124 and/or rear chassis 126 about the spherical connector 130-receptor 132 combination. In other words, the connection allows the base of the chassis 124 to move in relation to the rest of the system. Such pivotal or spherical movement maintains the front and rear chassis' in position over the body during running and walking activities where the shoulders of the wearer have a tendency to roll. The spherical connector can be realised by a ball and socket arrangement, with the ball preferably (but not necessarily) mounted to project outwardly from the bridge. Pivotal movement of the front and rear armour may be achieved in a different ways, including the preferred realisation described subsequently with reference to FIG. 11.

In relation to the lower girdle 104, a preferred configuration of the body armour 100 includes a pair of soft armour front pads 140, 142 that effectively extend downwardly below the ends of the shoulder straps 106, 108, thereby providing coverage of the external oblique muscle groups down to about the waistline of the wearer. The soft armour front pads 140, 142 are coupled together through an adjustable belt, typically and preferably realised by partially elastically webbing 144, although this could also be realised by a rigid band.

Sculptured side panels 150, 152 (preferably realised in soft armour) are preferably provided to underlay the front pads 140, 142 and to extend laterally around the sides and back of the wearer. The side panels, in combination with the shoulder straps 106, 108, define an opening for a wearer's arm to extend through, while maximizing armoured protection to the sides and ensuring effective movement of the wearer's limb. The rear armour plate 126 is arranged to overlay the side panels 150, 152, with a lower back bridge 154 coupling the side panels 150, 152 together at the back of the body armour 100. Again, the lower back bridge 154 may be realised by adjustable webbing, clips, buckles or other fastening device 156 that permit size adjustment, to accommodate chest expansion and generally to secure the body armour 100 around the wearer.

The side panels 150, 152 protecting the under arm area may be optionally attached to the shoulders at the pivot to allow a further rotating movement.

Furthermore, the side panels 150, 152 may be integrally formed with one or both of the front chassis 124 and rear chassis 126, thereby reducing over part count and providing more of a curved profile to the overall appearance of the front chassis 124 and/or rear chassis 126. Again, as will be understood, coupling together of the encircling front chassis and rear chassis is by way of Velcro® straps, an adjustable buckle or their functional equivalent.

The soft armour may be used as a spacer to the wearer's body, whereby channels are produced between the soft armour panels to permit air circulation. Alternatively, conventional foam padding and the like may be employed internally both to aid in comfort by eliminating rubbing of panel edges against the wearer's body and to facilitate air circulation.

The upper shoulder harness 102 may optionally be coupled to the lower girdle 104 to form a longer jacket, although it is preferable to maintain the upper harness 102 distinct from the lower girdle 104 to benefit from a higher degree of movement arising from overall articulation of the body armour 100. As purely a design option, the side panels 150, 152 may be either soft armour or hard armour or a combination. Indeed, a soft armour realisation may include pocketed regions into which may be inserted (as necessary) hard armour plates to augment lateral protection.

Figure 7:
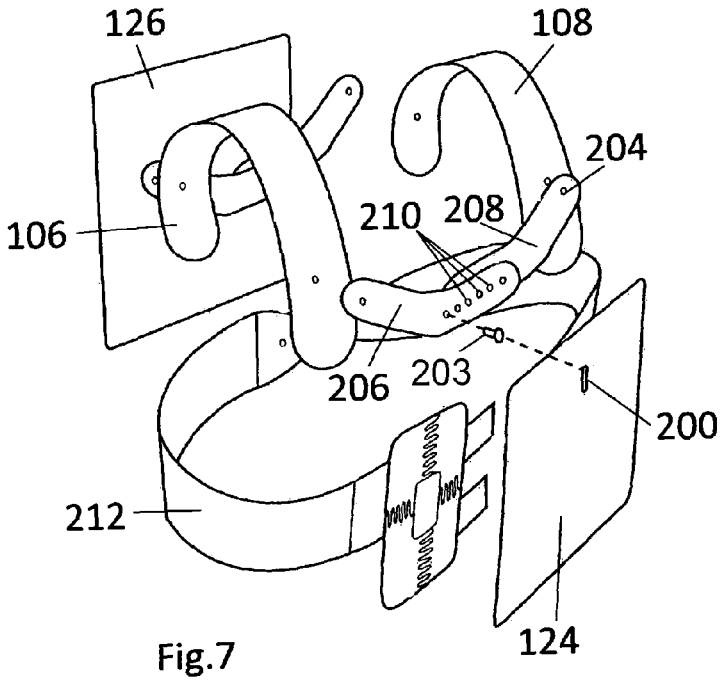
FIG. 7 is a perspective view of body armour according to another embodiment of the present invention.

Referring to FIG. 7, another embodiment of body armour according to the present invention is shown. In this embodiment, the chassis 124 or plate carrier has a slot 200 and peg 203 fixing to allow secure, direct or indirect mounting of the front chassis 124 while allowing the front armour plate to move vertically in relation to bridge. In the embodiment of FIG. 7, the bridge 204 is a pair or linking members 206, 208 that can be coupled together at a variety of locations by virtue of the engagement of the peg through a selected one of a plurality of through-holes 210. Additionally, in FIG. 7, the front chassis 124 is shown to be attached to a waistband 212 so that the wearer maintains full and free movement whilst the base of the front plate is kept located in the correct position. Attachment of the front armour plate may be by way of webbing, Velcro® or cord (for example and as will be readily appreciated). Again, in FIG. 7, the front armour plate 124 is optionally pivoted, although in this case it is around peg 203 that runs in slot 200.

Figure 8:
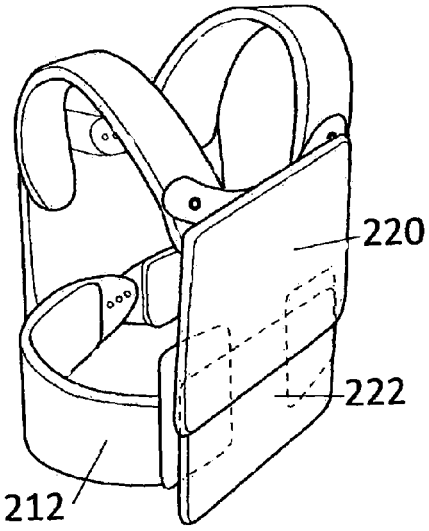
FIGS. 8 and 9 show additional embodiments of body armour in accordance with the principle in FIG. 1.

FIG. 8 is a modification of FIG. 7 in which the front chassis 124 is realised by an upper plate 220 that overlaps a lower plate 222 so that the waist of the user is not exposed when the user bends (backwards). The overlapping plates also allow forward bending by the user as the lower plate can move upwards in relation to the upper plate. In this configuration, the upper plate 220 is coupled to the bridge 204, whereas the lower plate is attached to the waistband 212.

Figure 9:
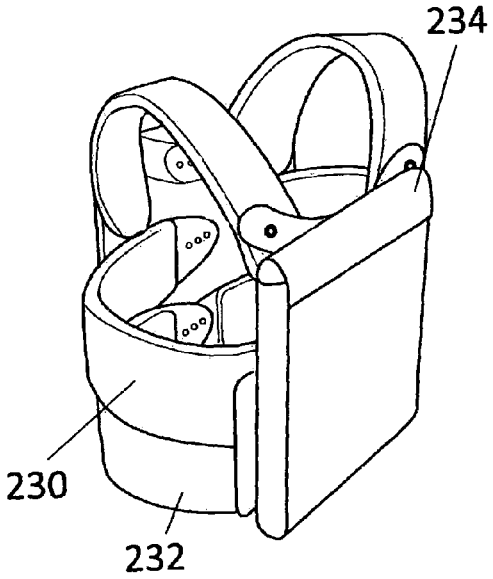

FIG. 9 shows another embodiment having upper 230 and lower 232 side panels for each side. The side panels 230, 232 are configured so that they are free to move in relation to each other allowing the user to bend sideways without compromising protection. Hard armour can be added to increase the level of protection by inserting a hard plate into an optional pocket 234 attached to the front element of the modular armour.

Figure 10:
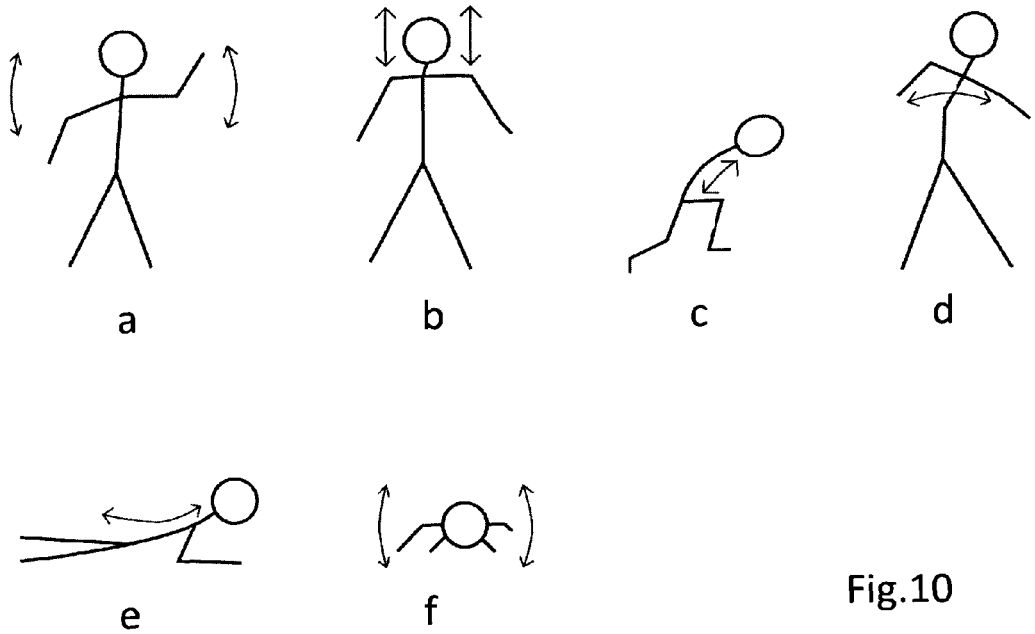
FIG. 10 shows a range of movements allowed to a wearer whilst wearing the body armour of the present invention.

FIG. 10 shows the full range of movement permitted by the body armour of the various embodiments of the present invention, especially arising from the de-coupling the upper shoulder harness 102 from the armour per se and the independent movement acquired by the pivoting connection of the shoulder straps 106, 108 within the upper harness 102. FIG. 10*a* shows independent movement of shoulders. FIG. 10*b* shows both shoulders moving together. FIG. 10*c* shows bending forward and kneeling. FIG. 10*d* shows bending sideways where the rib cage meets hip. FIG. 10*e* shows the user/wearer in the prone position where their back needs to be able to bend. Finally, FIG. 10*f* shows the user twisting.

Figure 11:
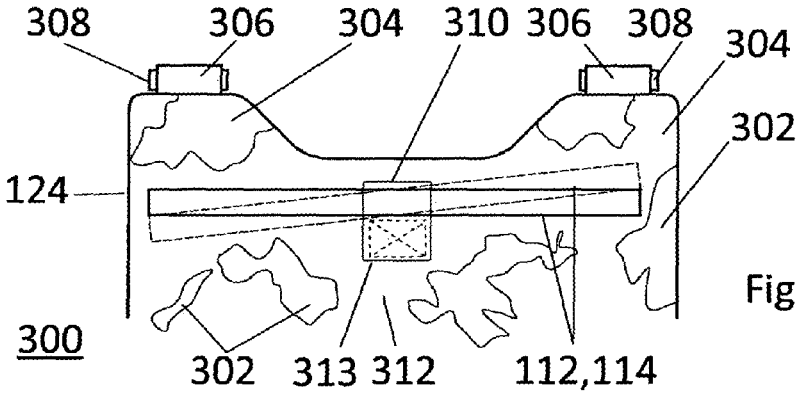
FIG. 11 is a rear view of a body chassis in accordance with a preferred realisation thereof, the body chassis for assembly within the body armour of FIG. 3.

Turning to FIG. 11, there is shown a rear view of a body chassis in accordance with a preferred realisation thereof, the body chassis for assembly within the body armour of FIG. 3. Firstly, as would be generally expected, the front chassis is typically covered by a cloth material 302 or otherwise directly painted with a random camouflage pattern 302. Proximate to collarbone regions 303, the chassis 124 includes optional attachment flaps 306, such as webbing or loops of material, that are permanently affixed to the chassis 124, e.g. by stitching. The flaps 306 allow additional layers or plates (such as plates 124*a* and 124*b*) to be selectively attached to the chassis 124, since the flaps 306 permit the attachment of fasteners 308 (such toggle fasteners and the like) thereto. Alternatively, the flaps 306 could be substituted or augmented by the use of suitably positioned Velcro® strips, as will be readily understood, to attach additional layers, panels or plates 124*a*, 124*b*.

It has been appreciated that it is desirable to pull the front and rear plates into the body of the wearer and, in this respect, the flaps 306 and fasteners 308 provide a way to effect tightening whilst permitting swivelling movement of the shoulders. Other mechanisms for pulling the front and rear plates into the body will be readily understood.

In relation to the attachment of the bridge 112, 114, this is preferably achieved through the use of a loop 310 of strong resilient material, such as flat webbing. The loop is secured to a rear surface 312 of the body chassis 124, e.g. by stitching 313, adhesive or the like. Preferably, the loop 310 is formed to allow a closed portion to be hinged relative to the rear surface 312. The loop 310 is sufficiently wide to allow the bridge 112, 114 to be threaded through the loop and, furthermore, to allow the angle of the bridge (relative to the horizontal) to be changed. In other words, dimensioning of the loop 310 and its hinged attachment to the chassis 124 allows for a limited pivoting movement of the bridge 112, 114; this is represented by the dotted outline of the bridge in an angled position. The use of webbing loops 310 avoids the necessity of having an armour plate (or the chassis 124) to be compromised with a through hole and/or socket (that may be realised by the afore-described spherical connector 130). As will be understood, while a ball and socket might provide a wider and more free movement of the bridge 112, 114 relative to the chassis 124, the nature of the ball and socket provides for a compromised degree of protection since the ball and socket could promote blunt trauma and represent an area of increased weakness in the body armour 100. The use of an appropriately dimensioned loop therefore achieves a functional equivalent of the spherical connector 130.

In one embodiment, the loop 310 could be realised as a molding within the rear surface 312 of the carrier plate.

Figure 12A:
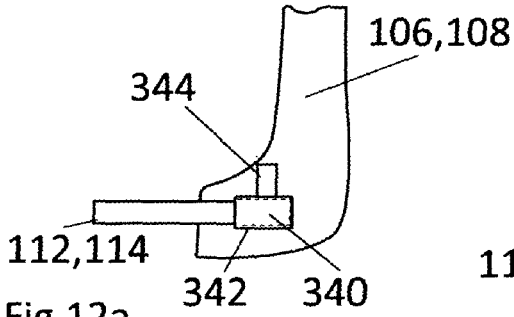
FIGS. 12*a* and 12*b* show a preferred mechanism for attaching a bridge connector to a shoulder strap in a preferred configuration of the body armour of FIGS. 3 and 11.
Figure 12B:
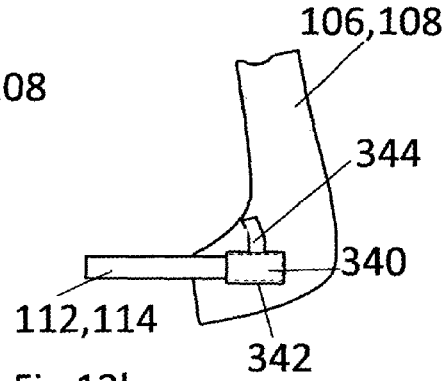
Figure 13:
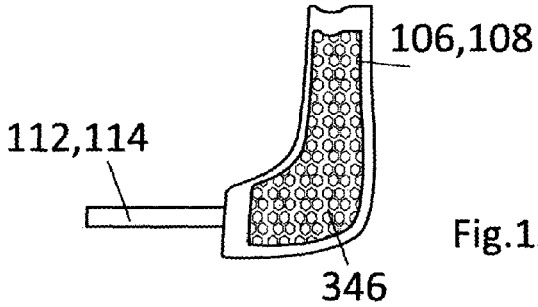
FIG. 13 is a representation of the shoulder strap of FIG. 11, including padding.

In relation to FIGS. 12*a* and 12*b*, a preferred mechanism for attaching a bridge to a shoulder strap 106, 108 of FIGS. 3 and 11 is shown. As previously described, an end of the bridge 112, 114 is retained within a closed pocket 340 typically realised by the doubling over of rectangular-shaped fabric materials (e.g. webbing) that is then stitched 342 along three of its four sides. The pocket 340 is located preferably on an outside of the shoulder strap 106, 108, although inside mounting is also possible. The pocket 340 is attached to the shoulder strap 106, 108 by an additional hinged flap or joint 344 that is securely hinged to the shoulder strap. The hinged flap 344 permits the bridge to pivot, twist or rotate relative to the angle of the shoulder strap relative to a nominal (square) orientation of each shoulder strap; this can be seen by contrasting FIG. 12*a* with FIG. 12*b*. The hinged flap 344 may be secured to the shoulder strap 106, 108 by stitching or any other suitable means of fastening, e.g. gluing. In this way, functional rotation and pivoting of the shoulder relative to the chassis 124, 126 and bridge 112, 114 is retained. Preferably, the length of the hinged flap 344 can be altered to permit customised fitting of the shoulder straps to the wearer. Techniques for lengthening or shortening the hinged flap 344 are readily known to the skilled addressee. By using a webbing arrangement, close sandwiching of the bridge 112, 114 between the shoulder strap and the chassis 124 is possible.

While the preferred embodiment discusses the use of a webbing hinge and flap, it will be understood that, within the context of the present invention, this hinge 344 could be realised by an alternative pivoting joint, such as a binding screw, rivet or pop-stud.

Optionally, the shoulder strap and particularly the pocket 340 may be covered with padding material 346, e.g. represented in an exemplary form of foam hexagons in a tessellated arrangement. The padding promotes additional comfort for the wearer.

Figure 14:
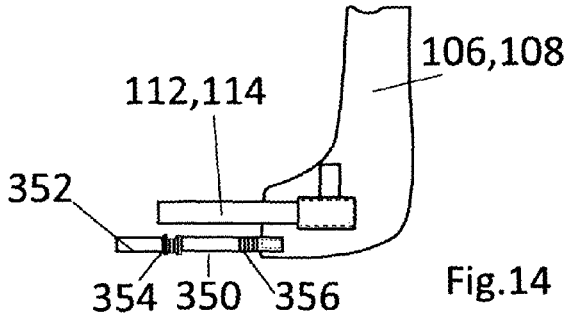
FIG. 14 is the shoulder strap, of FIG. 11, including a chest adjustment mechanism.

In the limit, since the bridge 112, 114 can be used to mount an armour plate, the bridges 112, 114 could (in combination with the shoulder straps 106, 108 and pockets 140) realise the entire upper shoulder harness 102. However, to prevent the components of the upper harness from separating it is preferred to include an additional chest strap 350; this is shown in FIG. 14. The chest strap 350 is typically in parallel with the bridge and, in a preferred embodiment, extends between (and is attached to) the left shoulder pad 106 and the right shoulder pad 108. The chest strap 350 typically includes a combination of flat webbing material 352, a length adjustor 354 (such as a buckle) and an elasticated region 356. Pre-tensioning of the chest strap 350 therefore ensures that each end of the bridge 112, 114 is retained in its associated pocket 340, while the elasticated region 356 permits the wearer to expand their chest (under deep breathing) and have the entire upper shoulder harness 102 expand appropriately and comfortably. Typically, the elasticated region 356 is only on one side of the chest strap 350. During expansion of the upper shoulder harness, the ends of the bridge 112, 114 may therefore become temporarily disengaged from a sealed end of the pocket 340, although the end of the bridge remains within the pocket 340.

The chest strap 350 generally extends across both the front and rear of the torso, i.e. it is made in two pieces. Each part of the chest strap 350 is therefore essentially in parallel with each bridge. To achieve fitting, only one of the two pieces need include an adjustable buckle or the like, whereby one piece of the chest strap 350 is a fixed length of webbing material, for example. Of course, both pieces of the chest strap 350 could include elasticated and adjustable mechanisms, since this is merely a design option.

Figure 6:
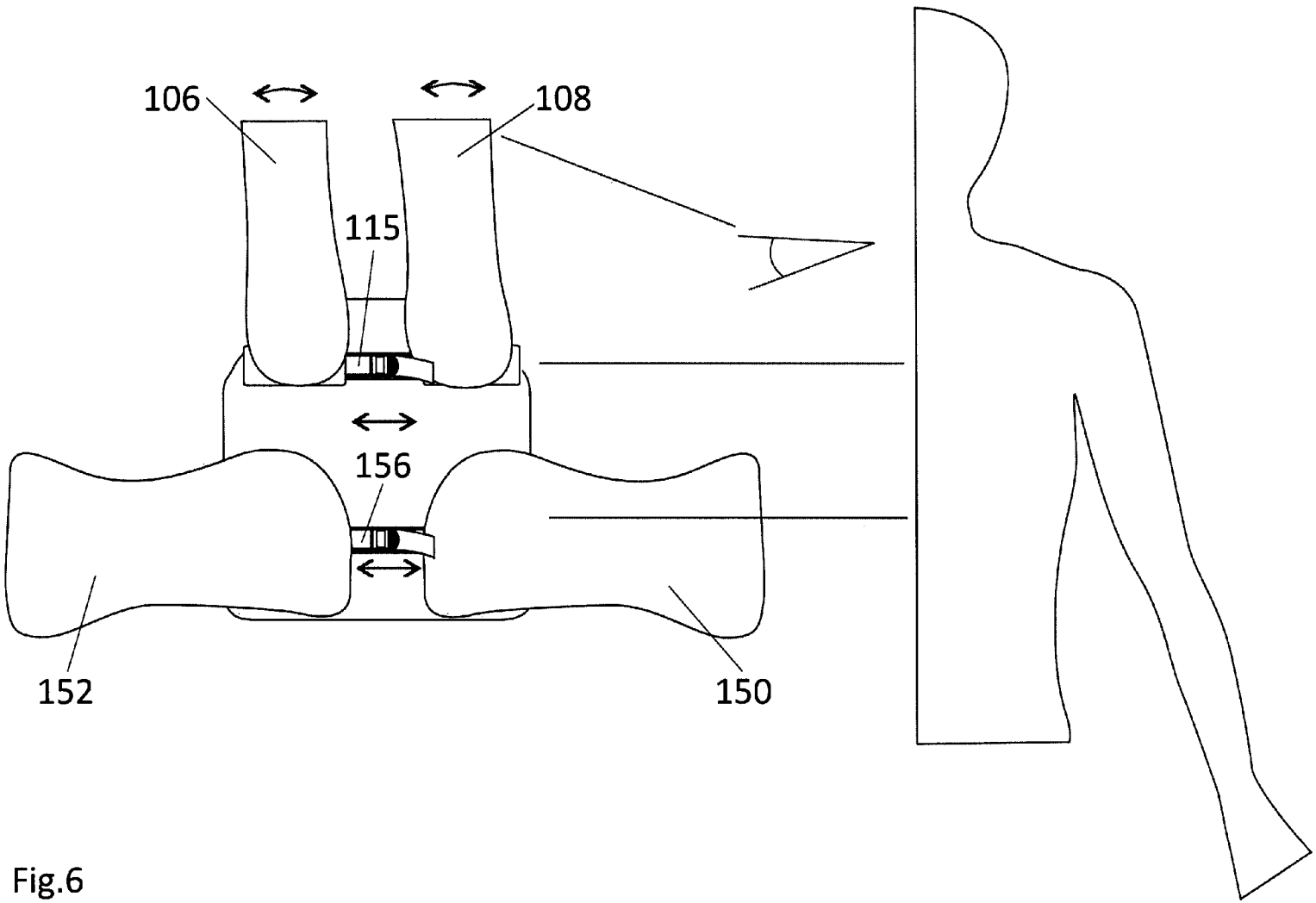
FIG. 6 illustrates interconnections between panels of the body armour of FIG. 3, the interconnections permitting, in use, limited expansion of the body armour.

The position of the chest strap 350 in FIG. 14 is exemplar. For example, it could overall the bridge 112, 114 (as shown in relation to FIG. 6).

Figure 15:
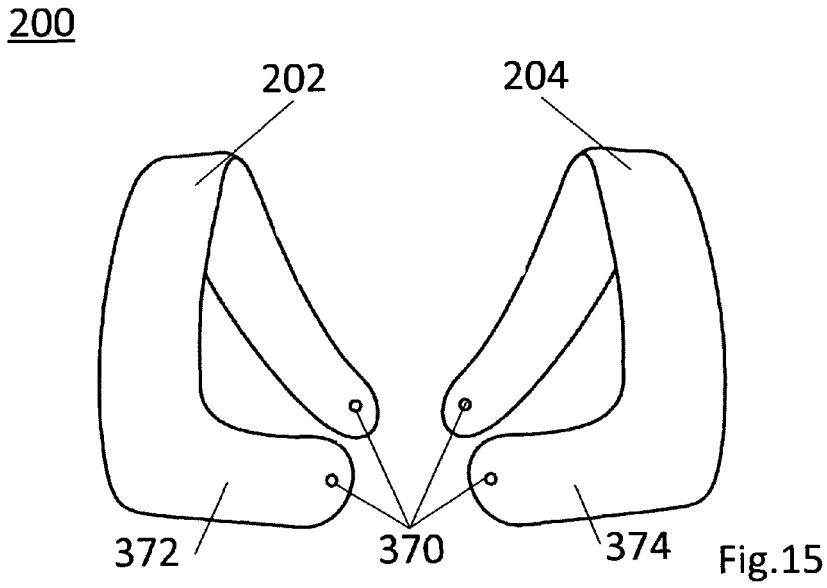
FIG. 15 shows a two-piece harness for body armour according to another embodiment of the present invention.

With reference to FIG. 15 there is shown a two-piece harness 200 for body armour according to another embodiment of the present invention. In common with the other embodiments described above, shoulder straps 202, 204 are able to pivot relative to each other, although the bridge is now integrally formed into the shoulder straps. In this respect, the two pieces are essentially a mirror image of each other, like a cupped walnut, and are attached together at, ideally and preferably, a central rotatable joint or pivot 370. In this respect, each end (both front and rear) of each shoulder strap is extended laterally inwardly such that bridging material 372, 372 generally extends tangentially to the loop of the shoulder straps. Coupling together of the shoulder straps (at the central rotatable joint 370) can be achieved using any of the techniques described above, including rivets, pop-studs, webbing flanges and ball and socket joints (as will all be readily appreciated). In this fashion, the pivot joint permits hinged opening and closing of the shoulder relative to each other.

It is also contemplated that only a single rotatable joint 370 is provided at either the front or back of the harness, thereby essentially producing an open harness that closes at the single rotatable joint, which joint 370 then still permits the left shoulder strap 204 and the right shoulder strap 202 independently to rotate about the at rotatable joint 370.

Preferably, the body armour system of the various embodiments includes a quick release system that permits release with a single and simple action, e.g. a cable or cord is pulled that allows the various components to disengage from each other. Quick release armour is well known and various known systems can be employed within the present invention, as will readily be appreciated.

In general, all panels and plates are arranged to overlap so that when the wearer moves or bends the individual elements do not separate to expose areas of the wearer's body.

It will, of course, be appreciated that the above description has been given by way of example only and that modifications in detail may be made within the scope of the present invention. For example, the swivel-jointed front armour plate may be implemented independently of both the articulated shoulder harness and the expandable nature of the armour. Similarly, the articulated shoulder harness may be implemented independently of both the swivel-jointed front plate and the expandable nature of the armour. And the expandable nature of the armour can likewise be implemented independently on the articulated shoulder harness and the swivel jointed front plate. For example, it is a design option as to whether the pivots are mounted internally or externally.

While the preferred embodiment makes use of both a front bridge 112 and back bridge 114 to connect the shoulder straps together, it is contemplated that one of these bridges could be realised by extending the shoulder straps laterally and integrally forming them together. However, by having only one pivotal connection of the shoulder straps to a single bridge realised by an independent component, a compromised degree of movement is provided in the upper housing 102 since swivelling movement of the straps can only occur at the pivotal connection (that is now located either at the front or back of the harness).

Also, while the specification discloses various embodiments, especially in relation to FIGS. 7 to 14, it will be understood that complementary features from these embodiments (particularly in the context of the modular configuration of the body armour and the use a waistband) may be incorporated into the earlier embodiments to adapt the overall configuration, as will be readily understood.

The invention claimed is:

1. Articulated body armour comprising:

an upper harness including a left shoulder strap and a right shoulder strap and a chassis having at least a front bridge and a back bridge, each of the front bridge and the back bridge formed as a separate component from the shoulder straps and each of said front bridge and said back bridge made from a rigid member having opposing ends, each of said front bridge and said back bridge spacing the left shoulder strap from the right shoulder strap, the upper harness assembled through intercoupling of the left and right shoulder straps via the front bridge and back bridge, the intercoupling achieved through at least four pivoting joints that allow each shoulder strap to rotate relative to both the front bridge and the back bridge, each one of said four pivoting joints located at each end of each shoulder strap and each pivoting joint coupling the end of its respective shoulder strap to one of said opposing ends of one of the front bridge and the back bridge, wherein intercoupling of the left shoulder strap and the right shoulder strap through the front bridge and the back bridge and via each pivoting joint allows for independent movement of each shoulder strap and rotation about each pivot joint;

a generally flat front plate;

a coupling mounting the front plate to the front bridge, the coupling allowing the front plate to rotate relative to the front bridge; and a back plate;

wherein the chassis produces a closed circuit within the upper harness of the body armour and the chassis supports both the front plate and the back plate.

2. The articulated body armour of claim 1, wherein each pivoting joint comprises:

a pocket dimensioned to receive an end of each bridge, said pocket thereby retaining one end of each bridge; and a hinged flap allowing twisting of the bridge relative to a nominal orientation of each shoulder strap.

3. The articulated body armour of claim 1, wherein the chassis further includes a chest strap substantially in parallel to the bridge, the chest strap coupling the left shoulder strap to the right shoulder strap and allowing alteration of the upper harness.

4. The articulated body armour of claim 3, wherein the chest strap includes at least one elasticated region that pretensions the upper harness to cause retention of the bridge in the pockets.

5. The articulated body armour of claim 1, wherein the front plate and the back plate comprises one or more layers of soft armour, hard armour or a combination of soft and hard armour.

6. The articulated body armour of claim 1, wherein at least one of a soft armour panel or a hard armour plate is mountable to the front plate, the front plate including a rear surface containing a loop with a channel dimensioned to receive the bridge therethrough, the channel allowing angled movement of the bridge therewithin, the loop coupling the carrier plate into the upper harness.

7. The articulated body armour of claim 1, wherein at least one of the front plate and the back plate includes integrally formed, sculpted side panels that are curved to extend at least partially around a wearer's torso.

8. The articulated body armour of claim 1, further comprising a lower girdle including soft armour pads, the lower girdle arranged, in use, at least partially to surround a wearer's lower torso and wherein the soft armour pads are arranged to partially overlap with the front plate and the back plate.

9. The articulated body armour of claim 8, wherein the lower girdle further includes an adjustable belt that links the soft armour front pads together around the wearer's lower torso.

10. The articulated body armour of claim 9, wherein the adjustable belt comprises partially elastically webbing.

11. The articulated body armour of claim 1, wherein the front bridge comprises:

a left rigid member having an outside end and an inner end having an overlap region, the outside end arranged to positively engage a first one of said pivoting joints to pivotally couple the outside end of the left rigid member to the left shoulder strap; and a right rigid member having an outside end and an inner end having an overlap region, the outside end arranged to positively engage a second one of said pivoting joints to pivotally couple the outside end of the right rigid member to the right shoulder strap; and wherein said overlap regions of said inner ends of the left rigid member and the right rigid member overlap one another and are secured to each other to form the front bridge at one of a plurality of selectable overlapping coupling points along the overlap.

12. The articulated body armour of claim 11, wherein each overlap region of the left rigid member and the right rigid member includes a plurality of through-holes, and the articulated body armour further includes a peg that (i) engages through a first through-hole of the plurality of through-holes in the left rigid member and (ii) engages through an aligned second through-hole of the plurality of through-holes in the right rigid member, wherein selection of the first through-hole and the second through-hole and engagement of the peg therethrough varies an end-to-end length of the front bridge.

* * * * *